United States Patent [19]

Larker et al.

[11] 3,956,604

[45] May 11, 1976

[54] HIGH PRESSURE APPARATUS HAVING MEANS FOR DETECTING A LEAKAGE

[75] Inventors: Hans Larker; Jan Nilsson, both of Robertsfors, Sweden

[73] Assignee: Allmanna Svenska Elektriska Aktiebolaget, Vasteras, Sweden

[22] Filed: June 19, 1974

[21] Appl. No.: 480,931

[30] Foreign Application Priority Data

June 26, 1973 Sweden ..... 7308927

[52] U.S. Cl. ..... 200/61.08; 73/40; 100/99; 137/67

[51] Int. Cl.[2] ..... H01H 35/00

[58] Field of Search ..... 73/38, 40 R, 46, 47; 100/99; 137/67, 68; 174/11 R; 285/1–3; 200/61.08, 82 R, 81 R, 81.9 R; 324/65 R; 340/238, 242, 248 E, 256, 421

[56] References Cited

UNITED STATES PATENTS

| | | | |
|---|---|---|---|
| 2,817,230 | 12/1957 | McCully | 73/46 |
| 3,067,465 | 12/1962 | Giardini et al. | 100/99 X |
| 3,161,131 | 12/1964 | Kilmer | 200/61.08 X |
| 3,333,641 | 8/1967 | Hansom et al. | 200/61.08 X |
| 3,438,246 | 4/1969 | Lofti | 73/40 |
| 3,789,297 | 1/1974 | Frolich | 73/46 X |

*Primary Examiner*—James R. Scott

[57] ABSTRACT

For detecting leakage past a high pressure seal which seals a space in which a high pressure exists, there is arranged outside the high pressure seal a collection space for pressure medium which leaks into the space and a device is provided connected with the space to detect cnanges in the pressure or temperature therein and to produce a signal or to stop the press. The detecting device may be an insulated cable which seals the space on the side remote from the high pressure seal and which may be broken by pressure within the space, thereby interrupting an electrical circuit.

2 Claims, 5 Drawing Figures

FIG. 1
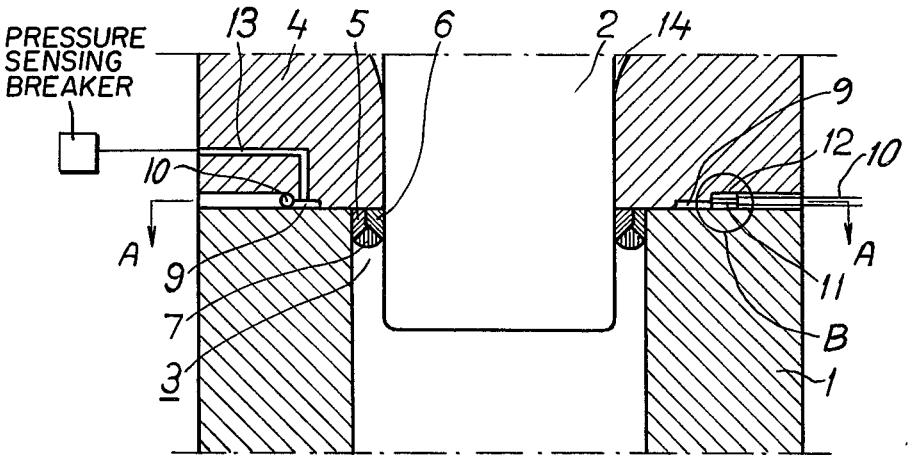
FIG. 4
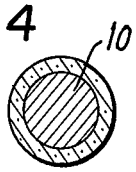
FIG. 3
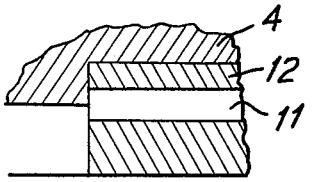
FIG. 2
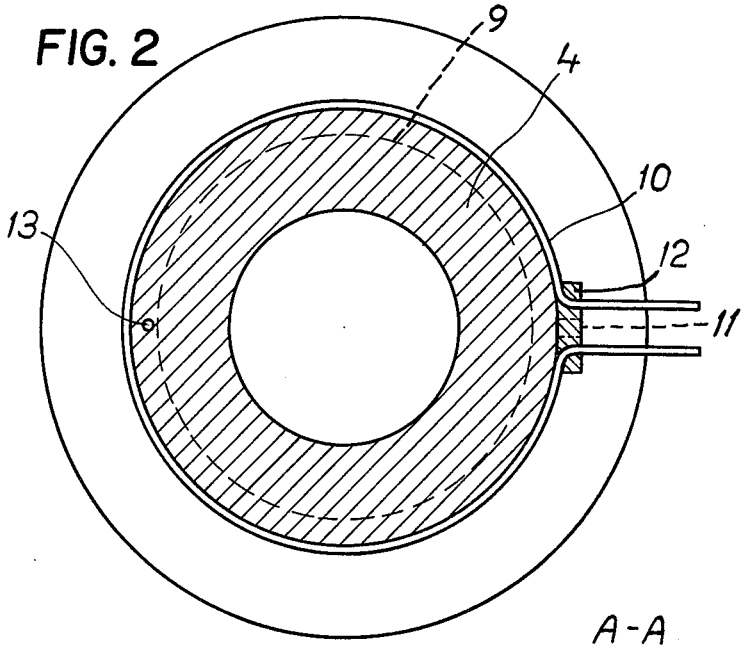
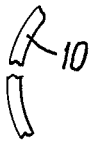
FIG. 5

HIGH PRESSURE APPARATUS HAVING MEANS FOR DETECTING A LEAKAGE

BACKGROUND OF THE INVENTION

1. Field of the Invention

In apparatus working with high pressure, for example containers in extrusion presses where the working pressure can be of the order of magnitude of 1000 – 2000 MPa, leakage past a seal often causes serious secondary damage if the leakage is not discovered and the press stopped in time. That severe damage may arise is easily understood if it is considered that the hydraulic power at the time may be 1 MW and that, in the event of leakage, a considerable part of this power is exerted in the few $mm^2$ which correspond to the leak. Further, it is difficult to determine from the outside if leakage occurs with the help of the pressure time curve for the main piston as this curve, in case of leakage, normally has the same appearance as when extrusion is taking place.

SUMMARY OF THE INVENTION

The present invention relates to a high pressure apparatus having a means for detecting leakage with a minimum loss of time. It comprises a collecting space for leaking pressure medium located outside a high pressure seal. The space is provided or communicates with detectors for sensing a temperature or pressure increase in the space caused by leaking pressure medium, for example oil. At a certain pressure or temperature the detector releases a signal and/or stops the press.

BRIEF DESCRIPTION OF THE DRAWINGS

One embodiment of the invention appears from the FIGS. 1 to 5, where

FIG. 1 shows a detail of a hydraulic pressure press and

FIG. 2 a section on the line A — A of FIG. 1.

FIG. 3 shows an enlargement of the portion B encircled in FIG. 1;

FIG. 4 is an enlarged cross-section through the wire; and

FIG. 5 shows the wire in broken condition.

DESCRIPTION OF THE PREFERRED EMBODIMENTS

In FIG. 1, 1 designates the high pressure cylinder of the press and 2 a piston insertable into said cylinder. A seal 3 is arranged around the piston and kept in position by a seal holder 4. The space at the upper part of the high pressure cylinder 1, which is defined by the piston 2, the seal holder 4 and the cylinder 1, is called the sealing zone. In this zone two sealing rings 5 and 6 and a packing 7 of elastic material, for example an O-ring of rubber, are located. Outside the sealing rings 5 and 6 and between the cylinder 1 and the seal holder 4 there is formed the space 9 which collects pressure medium leaking out from the press between the engaging surfaces of the high pressure cylinder and the seal holder. This space 9 is sealed outwardly by means of, for example, an electric cable 10. When the oil leaking out causes the pressure in the space 9 to rise above a certain limit, the cable 10 is broken, an electric current through the cable being thereby interrupted and a signal being emitted and/or the press being stopped.

The device is suitably provided with a narrow channel 11 through the sealing sleeve 12. This channel prevents a very moderate leakage or an elastic deformation of the space 9 to cause a false alarm.

Alternatively, the space 9 can be sealed off by means of some other member instead of the cable 10 and be connected to a pressure-sensing breaker (not shown) through a channel 13. Temperature-sensitive elements can also be positioned around the circumference of the cylinder 1, for example in the space 9, for detecting leakage past the sealing ring 5 or in space 14 in case of leakage at the inner sealing ring 6. The last-mentioned leakage can also be detected by means of the other sensing members mentioned in the description. The device according to the invention can of course be used in other types of high pressure seals than the one described above, with certain constructional adjustments.

We claim:

1. In a hydrostatic extrusion press having a high pressure cylinder and a seal holder engaging one end of the high pressure cylinder and a seal engaging the inner surface of the high pressure cylinder and the seal holder, means spaced away from and outside the seal forming an annular collecting space between adjacent surfaces of the seal holder and the high pressure cylinder, and a detector for sensing a temperature or pressure increase caused by pressure medium leaking between the engaging surfaces of the high pressure cylinder and the seal holder into such space, which detector includes means to release a signal and/or to stop the press in response to a predetermined temperature or pressure in the collecting space.

2. Apparatus according to claim 1, in which the outer wall of the collecting space (9) comprises an insulated cable which is broken at a sufficiently high pressure in the space, which causes an electric current through the cable to be interrupted.

* * * * *